US011173328B2

(12) United States Patent
Reed

(10) Patent No.: US 11,173,328 B2
(45) Date of Patent: Nov. 16, 2021

(54) SMOKE OR FIRE BARRIER FOR A CLEAN ROOM

(71) Applicant: Coopers Fire Limited, Hampshire (GB)

(72) Inventor: James Reed, Hampshire (GB)

(73) Assignee: Coopers Fire Ltd, Havant (GB)

( * ) Notice: Subject to any disclaimer, the term of this patent is extended or adjusted under 35 U.S.C. 154(b) by 2 days.

(21) Appl. No.: 16/471,845

(22) PCT Filed: Dec. 20, 2017

(86) PCT No.: PCT/GB2017/053828

§ 371 (c)(1),
(2) Date: Jun. 20, 2019

(87) PCT Pub. No.: WO2018/115860

PCT Pub. Date: Jun. 28, 2018

(65) Prior Publication Data

US 2020/0086149 A1 Mar. 19, 2020

(30) Foreign Application Priority Data

Dec. 20, 2016 (GB) ..... 1621718

(51) Int. Cl.
*A62C 2/10* (2006.01)

(52) U.S. Cl.
CPC ..... *A62C 2/10* (2013.01)

(58) Field of Classification Search
CPC ..... A62C 2/10; A62C 2/05
USPC ..... 169/48–50
See application file for complete search history.

(56) References Cited

U.S. PATENT DOCUMENTS

| | | | | |
|---|---|---|---|---|
| 2,350,287 | A | 5/1944 | Michelman | |
| 5,277,959 | A * | 1/1994 | Kourtides et al. | |
| 2016/0193488 | A1* | 7/2016 | Cooper | E06B 9/56 169/48 |

FOREIGN PATENT DOCUMENTS

| | | |
|---|---|---|
| EP | 2 754 468 A2 | 7/2014 |
| FR | 2 669 229 A1 | 5/1992 |
| WO | 2005/058423 A1 | 6/2005 |

* cited by examiner

*Primary Examiner* — Christopher S Kim
(74) *Attorney, Agent, or Firm* — Bay State IP, LLC

(57) ABSTRACT

A smoke or fire barrier (1), comprising a head box (2) which contains a roller (9). Extending from the head box are a pair of side guides (3) which guide a metallic foil curtain (5) from the roller, where it is stored, to the ground when deployed. At the bottom of the curtain (5), where it meets the ground when deployed is a bottom bar (4). The metallic foil curtain (5) is made up of individual foil panels (6). The curtain is made from a panel of stainless steel with dimples (8) across it. The dimples allow improved characteristics when rolling and being stored as it holds its shape better. The dimples also provide improved heat transfer characteristics.

21 Claims, 4 Drawing Sheets

SMOKE OR FIRE BARRIER FOR A CLEAN ROOM

CROSS REFERENCE TO RELATED APPLICATION

Figure 1:
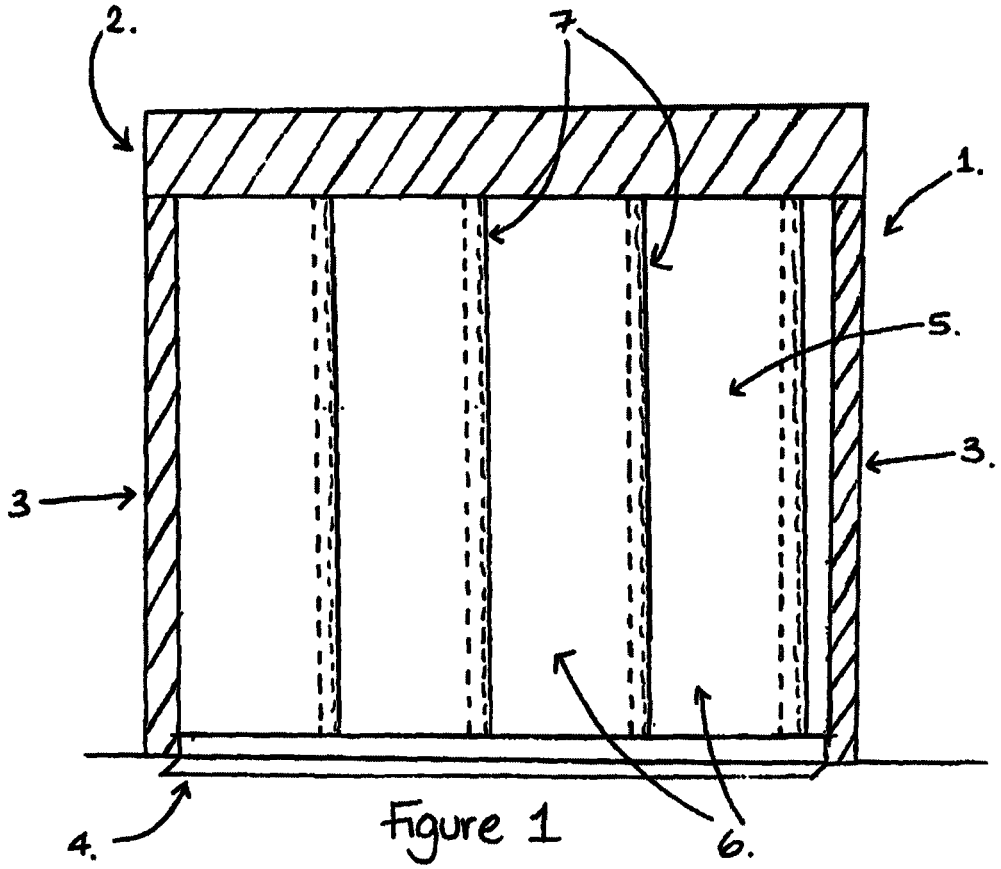

This application is for entry into the U.S. National Phase under § 371 for International Application No. PCT/GB2017/053828 having an international filing date of Dec. 20, 2017, and from which priority is claimed under all applicable sections of Title 35 of the United States Code including, but not limited to, Sections 120, 363, and 365(c), and which in turn claims priority under 35 USC 119 to Great Britain Patent Application No. 1621718.4 filed on Dec. 20, 2016.

The present invention relates to a smoke or fire barrier particularly but not exclusively for a clean room.

A clean room is an environment which has a controlled level of contamination. There are different standards depending on the country of operation which dictate the level of contamination that is allowed to be present in the room. For example in the UK they are ISO standards, an ISO 9 clean room is permitted to have more contamination than an ISO 1 clean room. Clean rooms are used across a variety of industries including the manufacture of pharmaceuticals or in specific scientific research that requires a contamination free environment.

Typically smoke or fire barriers use a textile fabric deployed from a roller and which has a resistance to fire. They can contain metallic elements in the form of a thread or reinforcements. The different elements of these curtains, including seams, reinforcing bars or the fabric itself provides crevices that can be contaminated and be difficult to clean to the standard required for a clean room.

There are a number of different cleaning agents required to clean a smoke or fire barrier to a clean room standard. Some of these cleaning agents can degrade the fabric of conventional smoke or fire barriers, depending what they are made from.

Metallic smoke or fire barriers are known in the art. They usually take the form of a series of horizontal metallic panels that form a shutter which folds in on itself when not in use. These types of smoke or fire barriers harbour dust and other contamination in the cavities between each panel and are therefore difficult to clean. For these reasons they are unsuitable for use in a clean room environment.

EP 2 754 468 discloses, in terms of its abstract:

A smoke or fire protection device to seal an opening comprising a flexible protection member that can be put in a protection arrangement in which the protection element counteracts the spread of smoke and/or fire through the opening, and can be put in a storage arrangement in which the opening is unsealed, wherein the protection element only comprises metal foil or metal foil and a wire mesh.

The object of the present invention is to provide an improved smoke or fire barrier which is suitable for use in a clean room.

According to the invention there is provided a smoke or fire barrier for a clean room comprising:

- a metallic curtain, which consists of:
  - at least one panel of metallic foil, having
  - a plurality of dimples arranged across the surface of the metallic foil,
- means for deployment and withdrawal of the curtain.

Normally the means for deployment of the curtain will include a roller from which the curtain can be unrolled for deployment. Alternatively it could be a concertina deployment means, preferably with radiused folds not imparting permanent deformation to the curtain as in an "S" shaped folded formation.

The dimples can be arranged in an array substantially parallel to the deployment direction, or transverse thereto or at an intermediate angle. Indeed the array can have a number of internal orientations, such that one is parallel to the deployment direction, one transverse and a third diagonal to the deployment direction.

Normally the array will be regular, but can be arranged in a random pattern or arranged to present an image or word.

The dimples may impressed in the foil from one side only, but are preferably impressed from both sides. The impressed dimples can have orientation in a particular direction, giving their array a predominant direction. However they are preferably symmetrical.

They may be continuous or they may have planar lands in between them.

Normally the impressions will have impressed ends which impart continuous curvature to the dimpled foil.

Normally we would expect the pitch between the dimples, measured in X, Y directions where these are the principal directions of the array, to be 4 mm and 25 mm, and preferably between 5 mm and 15 mm. In the preferred embodiment it is 7 mm. Equally we would normally expect the extent of the dimples, that is their peak to peak dimension transverse a mid-plane of the dimpled foil to be 0.5 mm to 2.5 mm and to preferably between 0.75 mm and 1.5 mm. In the preferred embodiment it is 1.0 mm.

The foil typically has a thickness of 0.04 mm however it can be envisaged that any thickness which allows the curtain to be deployed, retracted and stored would be suitable. Preferably the foil is between 30 micron and 100 micron in thickness. Normally it will be of stainless steel.

For larger curtains, the metallic curtain can be made up of a series of metallic foil panels connected at seams. The seams can be welded. The metallic foil panels can also be connected by means of a metallic hook and loop fastener or be sewn together with a metallic thread.

Preferably the seams are in the direction of deployment, at least where this is downwards. This seam orientation places less weight induced load on the seams than if they are parallel with the roller or at least across the direction of deployment. Nevertheless parallel, indeed angled seam orientation is possible, particularly if the drop of the curtain is greater than available foil length.

Preferably each seam consists of 4 thicknesses of the foil, each panel having a folded in hem and the two hems being hooked together. This arrangement hides cut edges of the foil and leaves folded edges exposed as "soft" edges. Alternatively the hems can be narrow and not inter-engaged, resulting in the seam having three thicknesses. Two thicknesses are possible but such a seam leaves sharp, cut edges exposed.

Dimples may not be present on the foil, however the presence of the dimples enables a thicker foil to be able to roll up like a traditional fire curtain.

The metallic curtain could have a further coating particularly but not exclusively containing an added pigment to change the colour or some fire retardant properties.

Figure 5:
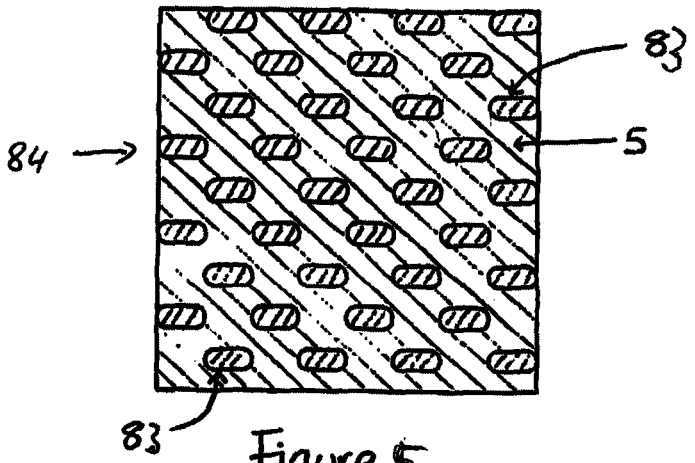
Figure 2:
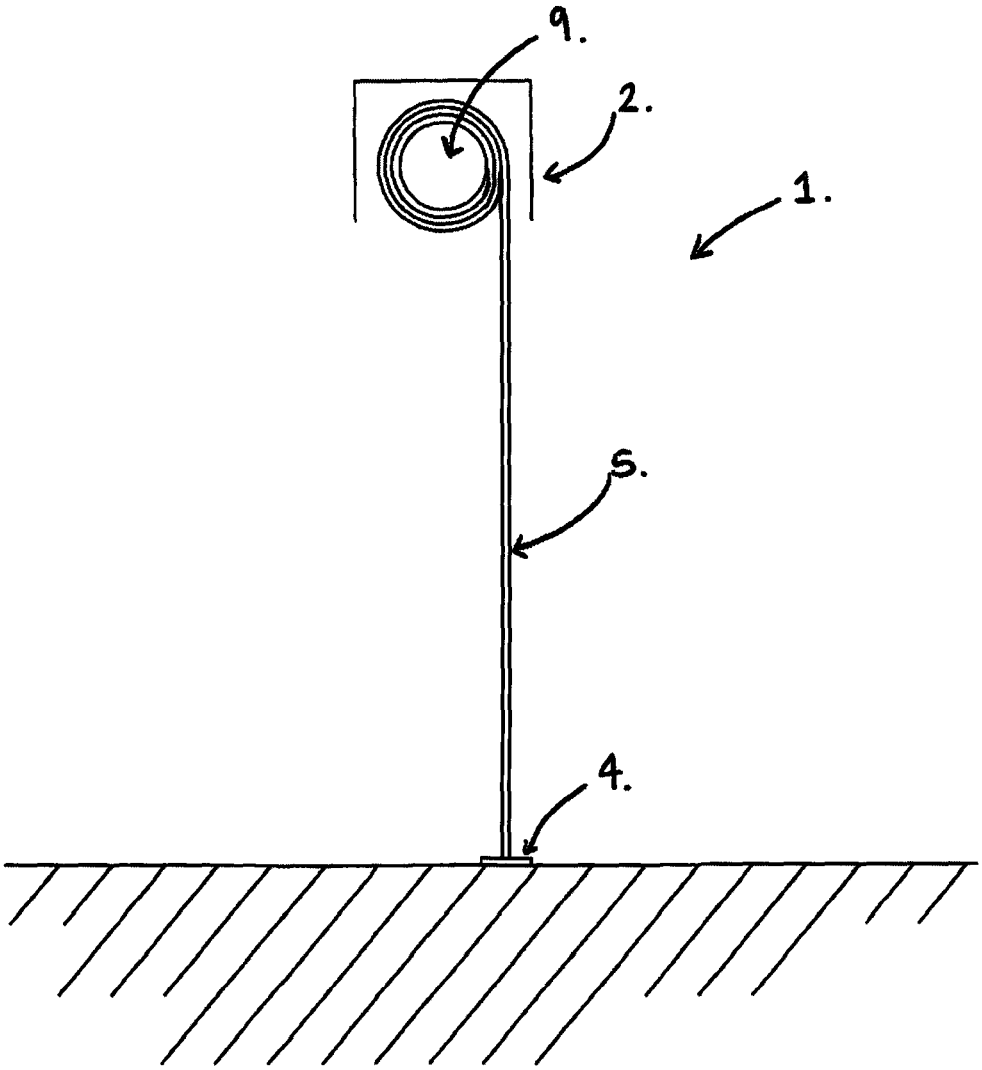
Figure 3:
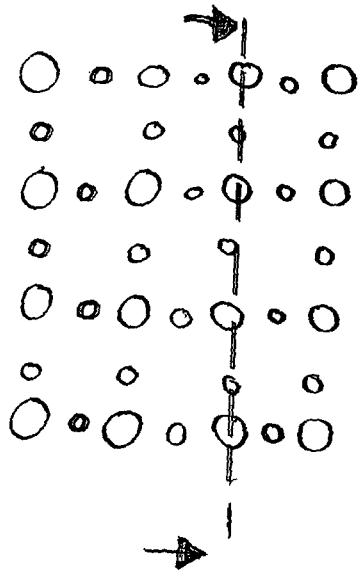
Figure 4:
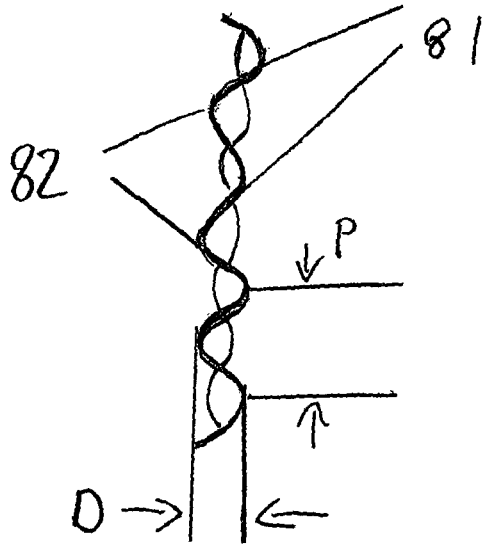
Figure 6:
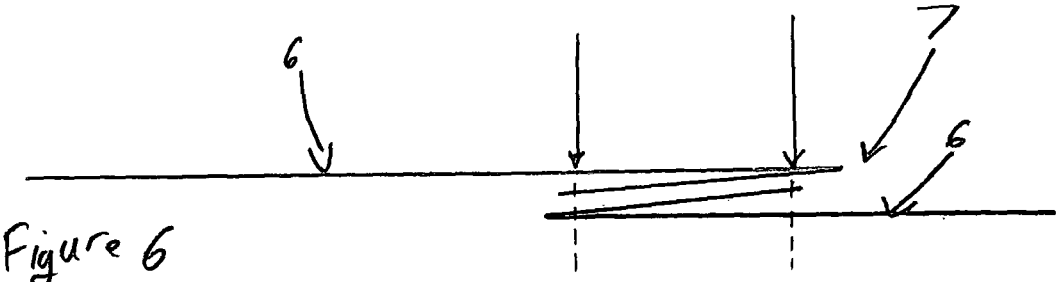
Figure 7:
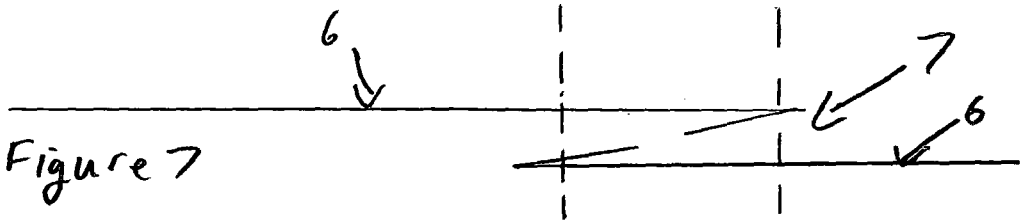
Figure 8:
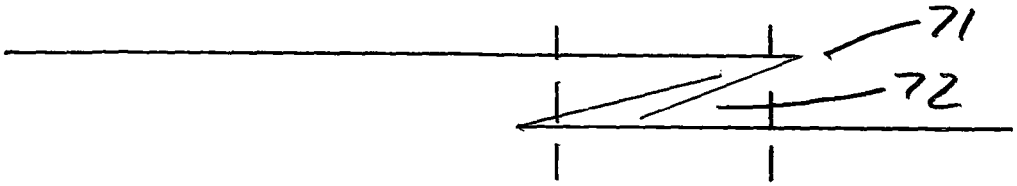

To help understanding of the invention, a specific embodiment thereof will now be described by way of example and with reference to the accompanying drawings, in which:

FIG. 1 is a front view of a smoke or fire barrier in accordance with the invention and suitable for use in a clean room, FIG. 2 is an end view of the barrier of FIG. 1, FIG. 3 is a scrap elevation of a dimpled foil of the curtain of FIG. 1, FIG. 4 is a cross-section on the line IV-IV in FIG. 3 of the dimpling of the foil, FIG. 5 is a view similar to FIG. 3 of an alternative foil showing dimples arranged at 45 degrees, FIG. 6 is a cross-section of a seam of FIG. 1 with 4 layers of foil, FIG. 7 is a similar cross-section of another seam with 3 layers of foil, FIG. 8 is a further similar cross-section of a sewn seam.

Referring to the Figures there is a smoke or fire barrier 1, comprising a head box 2 which contains a roller 9. Extending down from the head box are a pair of side guides 3 which guide a metallic foil curtain 5 from the roller, where it is stored, to a floor when deployed. At the bottom of the curtain 5, where it meets the floor when deployed is a bottom bar 4.

The metallic foil curtain 5 is made up of individual foil panels 6 that are welded together with a continuous spot weld to create substantially vertical seams 7. Substantially vertical seams are preferable to horizontal seams as they provide an improved weight bearing ability of the curtain in the vertical direction. At the seams, folded edges 71 of the panels can be provided, as shown in FIGS. 6-8, with hems 72 turned in. The hems can be laid against each other to provide four thicknesses of the foil at the seams. Or as shown in FIG. 7, the hems can be narrower and not overlapping, to give the no more than three thicknesses.

If there is a fire, the curtain is deployed from the head box 2 where it is stored in a roll. The curtain is unrolled, guided by the side guides and under the weight of the bottom bar 4, until this reaches the floor. It creates a barrier to fire and smoke.

The curtain is secured in the head box at its top end by welding the top of the curtain directly to the roll.

The curtain is made from a 0.04 mm thick, foil panel of stainless steel with dimples 8 arrayed across it. As shown in FIG. 4, they are arrayed at a pitch of 7 mm in both the X & Y direction of the panel and impressed from each side of the foil, as dimples 81 from one side and dimples 82 from the other side. The dimpling punches, not shown, have rounded ends imparting rounded shape to the dimples and continuous, substantially sinusoidal, curvature from one dimple to the next. The dimples 81,82 have a peak to peak dimension of 1.0 mm.

An alternative dimple array is shown in FIG. 5, where the dimples 83 are oblong, impressed from one side only and arrayed in aligned lines 84, which are generally horizontal in use.

The dimples facilitate smoother rolling and unrolling of the curtain compared to a plain stainless foil curtain. Further they give the curtain improved fire retardation characteristics.

The invention is not intended to be restricted to the details of the above described embodiment. For instance, the curtain could be detachable from the head box. The curtain may also be attached in the head box by any number of previously mentioned connection methods for example but not limited to, sewing with a metallic thread, welding, metallic hook and loop fastener means or by a clamping arrangement.

The dimples may be shaped differently to those described in the specific embodiment, dimples of many shapes can have the same characteristics of providing improved thermal characteristics.

The metallic foil panels are connected to one another by welding. However they could also be connected by sewing with a metallic thread as shown in FIG. 8 or a metallic hook and loop fastener—not shown.

The metallic curtain could have at least one further coating or layer, particularly but not exclusively with an added pigment to change the colour or some fire retardant properties.

The invention claimed is:

1. A smoke or fire barrier for a clean room comprising:
a head box;
a metallic curtain, comprising:
at least one panel of metallic foil, having
a plurality of dimples arranged across a surface of the metallic foil,
means for deployment of the curtain from the head box;
wherein the metallic curtain is made up of a series of metallic foil panels connected at seams; and
wherein the seams have folded in hems.

2. A smoke or fire barrier as claimed in claim 1, wherein the plurality of dimples are arranged in a regular array, a random pattern or arranged to present an image or word.

3. A smoke or fire barrier as claimed in claim 2, wherein the plurality of dimples are arranged in an array substantially parallel to a deployment direction, or transverse thereto or at an intermediate angle.

4. A smoke or fire barrier as claimed in claim 2, wherein the plurality of dimples are arranged in an array having a number of internal orientations, such that one is parallel to a deployment direction, one transverse to it and a third diagonal to it.

5. A smoke or fire barrier as claimed in claim 1, wherein the plurality of dimples are impressed in the metallic foil from one side only.

6. A smoke or fire barrier as claimed in claim 1, wherein the plurality of dimples are impressed in the metallic foil from both sides.

7. A smoke or fire barrier as claimed in claim 1, wherein the plurality of dimples are oriented in a predominant direction.

8. A smoke or fire barrier as claimed in claim 1, wherein the plurality of dimples are symmetrical.

9. A smoke or fire barrier as claimed in claim 8, wherein the plurality of dimples are continuous.

10. A smoke or fire barrier as claimed in claim 8, wherein the dimples have impressed ends which impart a continuous curvature to the dimpled foil.

11. A smoke or fire barrier as claimed in claim 1, wherein the plurality of dimples have a pitch between them in a two dimensional array between 4 mm and 25 mm.

12. A smoke or fire barrier as claimed in claim 1, wherein the each dimple has a peak to peak dimension between 0.5 mm to 2.5 mm.

13. A smoke or fire barrier as claimed in claim 1, wherein the metallic foil has a thickness of between 30 microns and 100 microns.

14. A smoke or fire barrier as claimed in claim 13, wherein the metallic foil is of stainless steel.

15. A smoke or fire barrier as claimed in claim 1, wherein the seams are welded, connected by a metallic hook and loop fastener or sewn together with a metallic thread.

16. A smoke or fire barrier as claimed in claim 1, wherein the seams are arranged in a direction of deployment and/or transverse to this direction.

17. A smoke or fire barrier as claimed in claim 1, wherein the metallic curtain has a further pigmented and/or fire retardant coating.

18. A smoke or fire barrier as claimed in claim 1, wherein the plurality of dimples have a pitch between each dimple of between 5 mm and 15 mm.

19. A smoke or fire barrier as claimed in claim 18, wherein the pitch between the dimples in two dimensions in a two dimensional array, is between 5 mm and 15 mm.

20. A smoke or fire barrier as claimed in claim 1, wherein the metallic foil panels are welded at the seams.

21. A smoke or fire barrier as claimed in claim 1, wherein the hems are welded.

* * * * *